US009568153B2

(12) United States Patent
Glachman

(10) Patent No.: US 9,568,153 B2
(45) Date of Patent: Feb. 14, 2017

(54) LED REPLACEMENT LIGHTING ELEMENT

(71) Applicant: Green Lumens LLC, Boca Raton, FL (US)

(72) Inventor: Neil Glachman, Boca Raton, FL (US)

(73) Assignee: GREEN LUMENS LLC, Boca Raton, FL (US)

( * ) Notice: Subject to any disclaimer, the term of this patent is extended or adjusted under 35 U.S.C. 154(b) by 229 days.

(21) Appl. No.: 14/499,997

(22) Filed: Sep. 29, 2014

(65) Prior Publication Data

US 2016/0091149 A1 Mar. 31, 2016

(51) Int. Cl.

| | |
|---|---|
| ***F21S 4/00*** | (2016.01) |
| ***F21K 99/00*** | (2016.01) |
| ***F21V 15/015*** | (2006.01) |
| *F21V 3/00* | (2015.01) |
| *F21V 17/10* | (2006.01) |

(52) U.S. Cl.

CPC ..... *F21K 9/175* (2013.01); *F21K 9/27* (2016.08); *F21V 15/015* (2013.01); *F21V 3/00* (2013.01); *F21V 17/104* (2013.01)

(58) Field of Classification Search

CPC ..... F21K 9/17; F21V 23/06; F21V 15/015; F21V 17/104; F21V 3/00

See application file for complete search history.

(56) References Cited

U.S. PATENT DOCUMENTS

| | | | | |
|---|---|---|---|---|
| 6,283,612 | B1 * | 9/2001 | Hunter | F21V 15/015 362/217.05 |
| 6,860,628 | B2 * | 3/2005 | Robertson | F21K 9/17 313/512 |
| 8,579,463 | B2 * | 11/2013 | Clough | F21K 9/30 362/217.1 |
| 9,028,105 | B2 * | 5/2015 | Barnetson | F21K 9/10 315/247 |
| 2005/0056858 | A1 * | 3/2005 | Kakiuchi | H01L 33/60 257/100 |
| 2005/0162093 | A1 * | 7/2005 | Timmermans | F21K 9/17 315/200 R |
| 2005/0265019 | A1 * | 12/2005 | Sommers | A47F 3/001 362/217.16 |
| 2006/0193131 | A1 * | 8/2006 | McGrath | H05B 33/0803 362/227 |
| 2007/0228999 | A1 * | 10/2007 | Kit | F21K 9/17 315/291 |
| 2009/0058317 | A1 * | 3/2009 | Tsai | F21K 9/00 315/291 |

(Continued)

*Primary Examiner* — Ali Alavi

(74) *Attorney, Agent, or Firm* — Levenfield Pearlstein, LLC

(57) ABSTRACT

A light emitting diode (LED) light element includes a support portion, and a LED assembly mounted to the support portion. The LED assembly includes a plurality of LEDs mounted thereto and conductors extending therefrom. A lens is configured to engage the support portion and cover the LEDs. A pair of end caps are configured to cover ends of the support portion and lens. Each end cap includes first portions configured to enclose its respective support portion and lens ends. Each end cap includes a second portion having a periphery that is smaller than a periphery of the first portion. Each end cap has a pair of pins extending therefrom that are in electrical communication with the LED assembly via the conductors.

9 Claims, 3 Drawing Sheets

(56) References Cited

U.S. PATENT DOCUMENTS

| | | | | |
|---|---|---|---|---|
| 2012/0230033 | A1* | 9/2012 | Yoon | F21K 9/00 362/267 |
| 2012/0319582 | A1* | 12/2012 | Shan | H05B 33/0803 315/77 |
| 2013/0314925 | A1* | 11/2013 | Jiang | F21V 5/04 362/311.02 |

* cited by examiner

LED REPLACEMENT LIGHTING ELEMENT

BACKGROUND

Lighting systems of many different types are known. One very common type of lighting system for office, commercial, light industrial facilities and the like is the well-recognized fluorescent lighting fixture.

Fluorescent fixtures are available in many different types and designs. One commonly used fixture for office, commercial and industrial settings is a 48 inch long tubular bulb mounted in a fixture that accommodates from one to four bulbs. The bulbs can be, for example, of the T5, T8 or T12 designation (T5 is ⅝ inch diameter, T8 is 1 inch diameter and T12 is 1½ inch diameter).

The bulbs, which have two pin type connectors extending from each end, fit into a fixture that includes a pair of sockets for receiving the pins. The sockets are of a size such that they accommodate the pins (and the bulb diameter), without much additional space available.

It will be appreciated that many of these fixtures are quite expensive. There is a considerable amount of material, including support assemblies, reflector surfaces and the like. Many such fixtures, such as troffers are also highly engineered products adding to the cost of the fixture.

While fluorescent lighting has become the standard in many facilities due to the lower energy costs compared to incandescent lighting, there are still drawbacks. One such drawback is the energy cost, especially when compared to currently available light emitting diode (LED) systems. Moreover, the internal components of fluorescent lighting fixtures (e.g., ballasts) can be quite costly and may require periodic replacement.

Some currently known fixtures include reflectors and aesthetic panels that are sized to accommodate a specific size or type of bulb. For example, some fixtures are designed to accommodate a T5 bulb and include an opening in the fixture panels through which only a T5 bulb will fit and a socket that will accommodate only the pins for the T5 bulb.

Accordingly, there is a need for a LED replacement system for known fluorescent lighting systems and fixtures. Desirably, such a replacement system provides at least as much, if not more, light or illumination than the lighting elements that are replaced. More desirably still, such a system allows for installing an LED light element directly into known fluorescent fixtures with minimal modifications to the fluorescent fixture.

SUMMARY

A light emitting diode (LED) light element includes a support portion and a LED assembly mounted to the support portion. The LED assembly includes a plurality of LEDs mounted thereto. The assembly has conductors extending therefrom;

A lens is configured to engage the support portion. The lens covers the LEDs.

A pair of end caps configured to cover ends of the support portion and lens. Each end cap includes a first portion configured to enclose its respective support portion and lens ends and a second portion having a periphery that is smaller than a periphery of the first portion. Each end cap has a pair of pins extending therefrom. The pins are in electrical communication with the LED assembly via the conductors.

In an embodiment, the ends of the support portion and lens are circular and the first and second portions of the end caps are circular. The first portion has a larger diameter than the second portion, and the pins extend from the second portion. The smaller second portion can have, for example, a diameter of about ⅝ inches and the larger first portion can have, for example, a diameter of at least about 1 inch.

The second portion can extend from the first portion in an off-center or eccentric configuration. The first and second portions can be configured such that a point on a periphery of the second portion is coincidental with a point on a periphery of the first portion. In such an embodiment, the pins extend from the second portion along a diameter of the second portion.

The support portion can include a planar mounting surface and an arcuate outer wall. The LED assembly can be mounted to the planar mounting surface. The arcuate outer wall has can be formed with a scalloped profile.

The support portion and the lens can include securing elements to secure the lens to the mounting portion. In an embodiment, the securing elements include cooperating flanges on opposing sides of the support portion and the lens. The lens can include a pair of flexible retaining fingers extending therefrom that are configured to engage the LED light assembly when the lens is in place on the support portion.

These and other features and advantages of the present invention will be apparent from the following detailed description, in conjunction with the appended claims.

BRIEF DESCRIPTION OF THE DRAWINGS

The benefits and advantages of the present invention will become more readily apparent to those of ordinary skill in the relevant art after reviewing the following detailed description and accompanying drawings, wherein.

DESCRIPTION

Figure 1:
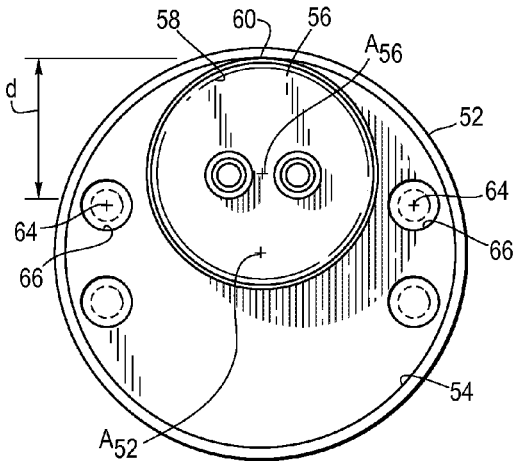
FIG. 1 is an end view of a LED light element or tube that is configures to insert directly into a fluorescent light fixture.

While the present device is susceptible of embodiment in various forms, there is shown in the drawings and will hereinafter be described a presently preferred embodiment with the understanding that the present disclosure is to be considered an exemplification thereof and is not intended to be limited to the specific embodiment illustrated.

Figure 2:
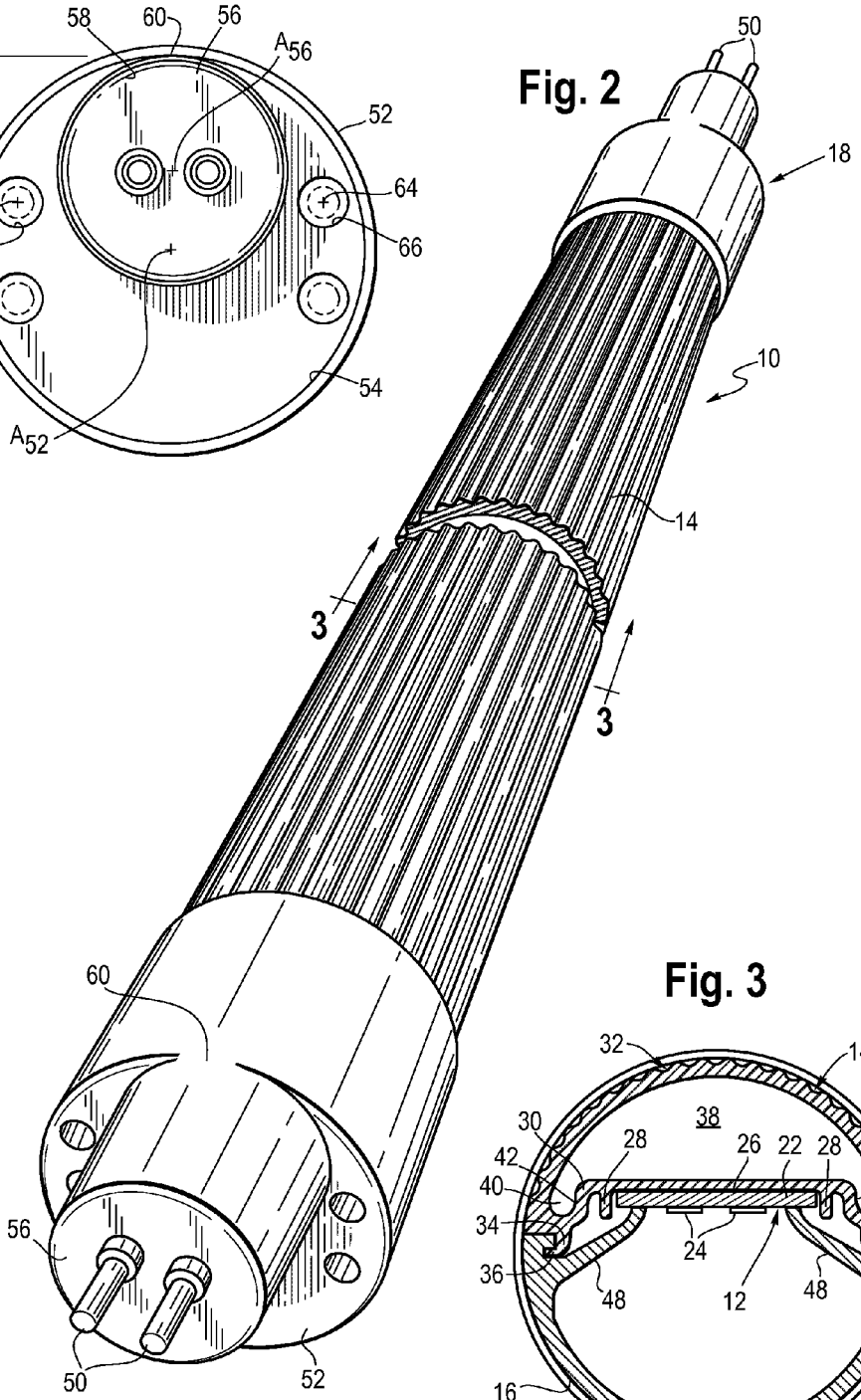
FIG. 2 is a perspective view of the LED light element.
Figure 3:
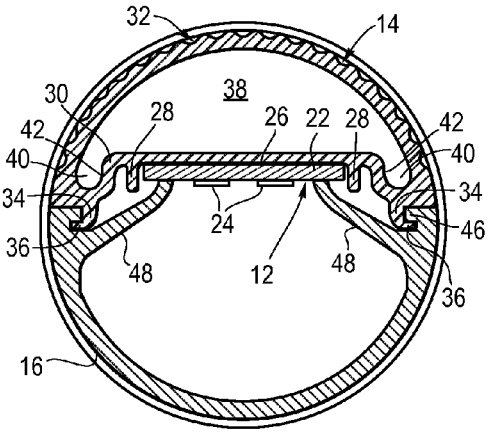
FIG. 3 is a cross-sectional view taken along line 3-3 of FIG. 2.
Figure 4:
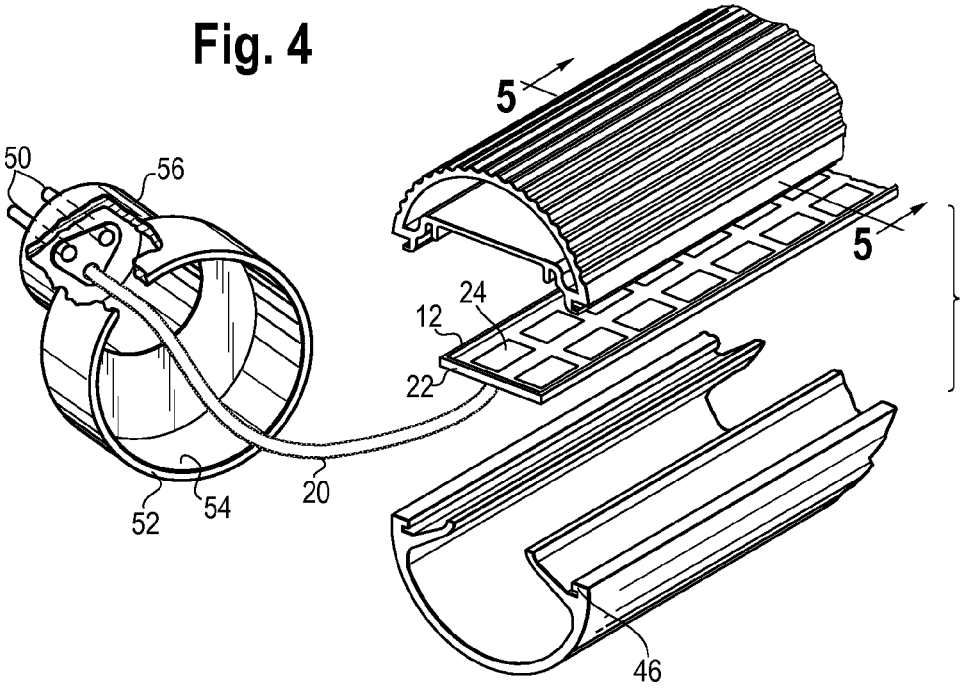
FIG. 4 is an exploded view of an end of the light element.

Referring now to the figures and in particular to FIGS. 2-4, there is shown a light emitting diode (LED) light element or tube 10. The element 10 includes a LED assembly 12, a support portion 14, a lens 16, a pair of end caps 18 and connectors 20 extending between the LED assembly 12 and the end caps 18.

The LED assembly 12 includes an elongated base portion 22 onto which a plurality of LEDs 24 are mounted. The base portion 22 can be a circuit board onto which the LEDs 24 are mounted for direct electrical connection. The design and configuration of such a mounting arrangement will be appreciated by those skilled in the art. In the illustrated LED assembly 12, two rows of LEDs 24 are mounted to the base portion 22 to provide a desired amount of illumination at least equivalent to the illumination provided by a comparable size fluorescent light bulb. Those skilled in the art will also appreciate that the LEDs 24 can be selected to provide not only a desired illumination but also a specific color temperature to emulate a desired lighting effect (e.g., bright sunlight, indoor lighting, "soft" lighting and the like).

The LED assembly 12 is mounted to the support 14. An embodiment of the support 14 has a generally semi-circular profile (cross-section) and includes a planar mounting surface 26 to which the LED assembly 12 is mounted. A pair of centering flanges 28 extend downwardly from the mounting surface 26 to provide a guide or channel for the LED assembly 12 to assure that the assembly 12 is properly positioned on and mounted to the support mounting surface 26. Ends 30 of the support 14, outside of the centering flanges 28, extend outward to the outer arcuate or semicircular wall 32. A pair of downwardly and outwardly extending flanges 34 are formed at the juncture of the ends 30 and the outer wall 32. The flanges 34 define L-shaped hooks 36 at the flange 34 ends.

A best seen in FIG. 3, the support 14 can include a hollow central region 38 that can extend along the length of the support 14. Relief areas 40 are formed at the inner junctures 42 of the outer wall 32 and the ends 30.

Figure 5:
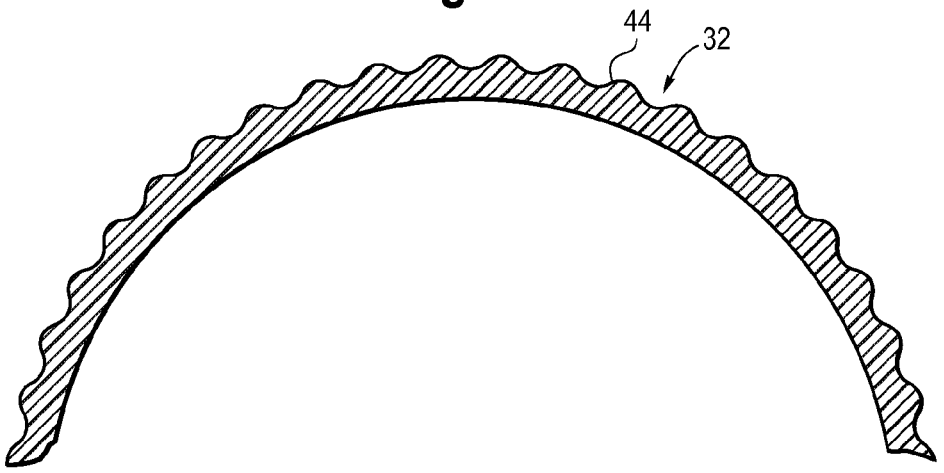
FIG. 5 is an enlarged, partial view of the support portion of the light element.
Figure 6:
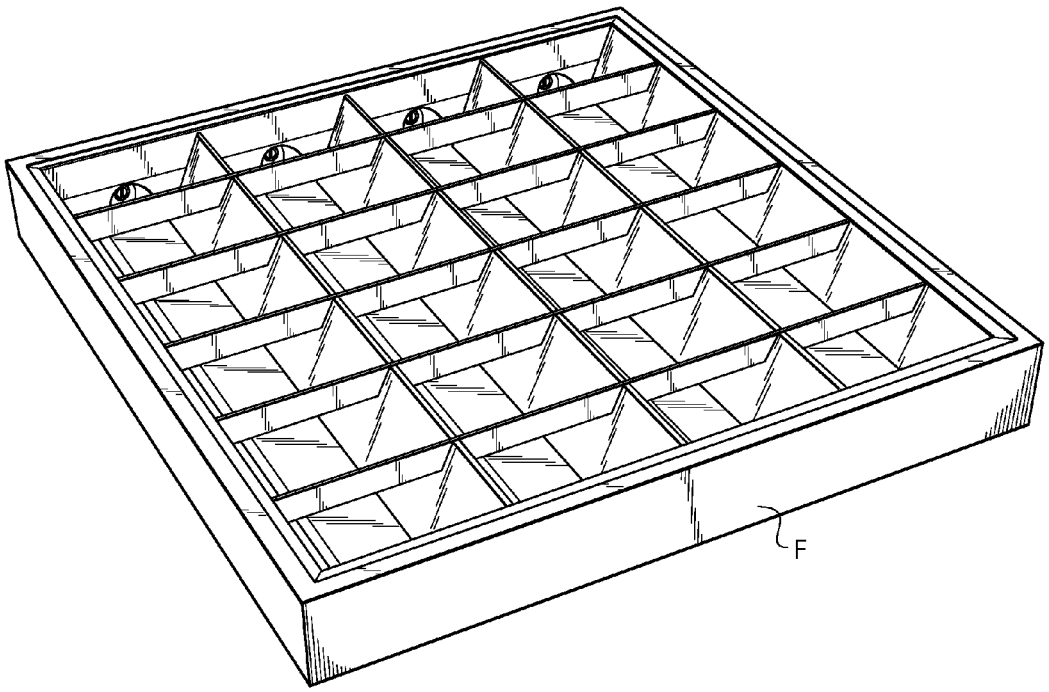
FIG. 6 is an illustration of an example of a fluorescent lighting fixture.
Figure 7:
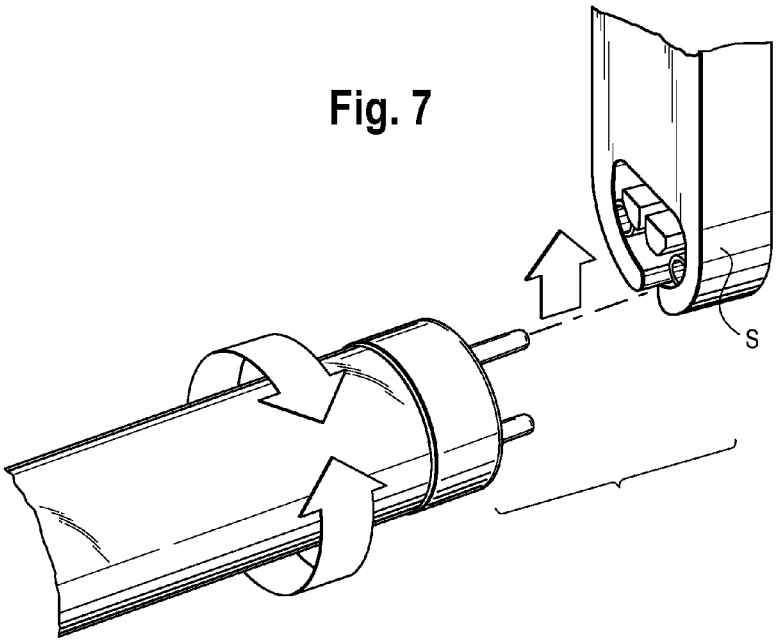
FIG. 7 is an illustration of an example of a fixture socket.

In an embodiment, as best seen in FIG. 5, the outer arcuate or semicircular wall 32 is formed having a scalloped profile as indicated at 44. The scalloped profile 44 increases the outer surface area of the wall 32. Those skilled in the art will appreciate that even though LEDs are low power consumption devices, and thus generate less heat than other known forms of lighting devices, they nevertheless still generate heat. As such the support 14 functions as a heat sink in addition to its support function. The scallops 44 formed on the outer wall 32, which provide a larger surface area than a comparable smooth wall, thus serve to increase the ability of the LED element 10 to dissipate heat.

In an embodiment, the support portion 14 is formed from a heat dissipating material. One suitable material is aluminum due to its relative low cost and ease of manufacture. Because of the longitudinally consistent shape, the support 14 can be fabricated as an extruded element, which also serves to facilitate manufacture of the LED light element 10.

The lens 16 forms the complement to the support wall 32. The lens 16 is formed form a transparent or translucent material to allow for light to be emitted from the LED light element 10 through the lens 16. The lens 16 can be configured to diffuse and/or spread the light from the LEDs 24.

The lens can include a pair of fingers or flanges 46 that cooperate with the flanges 34 on the support portion 14 to secure the lens 16 in place on the support 14. In a present embodiment, the lens 16 includes a pair of elongated flexible retaining fingers 48 that, when the lens 16 is in place, are positioned on the LED assembly 12 (on the base portion 22), which tensions the lens flanges 46 and helps to maintain the lens 16 affixed to the support 14. In such an arrangement, the tensioned lens flanges 46 facilitate maintaining the lens 16 affixed to the support 14 without adhesives or the like, further reducing costs for manufacture. As with the support portion 14, the lens 16 can be fabricated as an extruded element from known and readily available materials, such as plastics and the like. Although the lens 16 is shown as having a semicircular shape (to form a circular element 10 with the support portion 14), it will be appreciated that lens 16 shapes other than semicircular can be used in the present LED light element 10.

The end caps 18 are illustrated in FIGS. 1, 3 and 4. The end caps 18 serve a number of functions. First, they enclose the ends of the LED light element 10. Second, the end caps 18 provide for electrical connection between the LED assembly 12 and the light fixture F via a pair of pin connectors 50 extending outwardly from the end caps 18. Third, the end caps 18 are configured to permit mounting or installing the LED light element 10 in known and widely commercially used standard fluorescent light fixtures.

The end caps 18 include a first portion 52 having an inner periphery 54 that corresponds to the outer shape or periphery of the mated support portion 14 and lens 16. In the embodiment illustrated in the figures, the inner periphery 54 of the cap first portion 52 is circular to correspond to and enclose the mated circular support portion 14 and lens 16. It will, however, be understood that any shape support 14 and lens 16 combination can be used in the manufacture of the LED light element 10.

The end caps 18 include a second portion 56 that has a smaller periphery 58 than that of the first portion 52. The second portion 56 extends from the first portion 52, opposite the support 14 and lens 16 and includes the pair of pin connectors for insertion into the fixture socket S. In a present embodiment, the first and second portions 52, 56 are circular and the second, smaller portion 56, is positioned eccentrically or off-center relative to the first portion 56 (see, FIG. 1, $A_{52}$ and $A_{54}$). As best seen in FIGS. 1 and 2, the second, smaller portion 56 has a point 60 on its periphery that is common with the first portion 52 at the top of the cap 18, or at a point coincident with a center $C_{14}$ of the support portion 14. In this manner the smallest distance between the pins 50 and the periphery of the larger portion 52 is at that location that is installed in the fixture F. Also as seen in FIGS. 1 and 2, in an embodiment, the first and second portions 52, 56 of the end cap 18 are circular and thus the second portion 56 is eccentric relative to the first portion 52. This configuration permits installing a larger size or diameter bulb in a fixture design to accommodate a smaller bulb. For example, the present LED light element 10 permits installing a T8 size LED light element 10 (having a diameter of about 1 inch) in a fixture F designed to accommodate a T5 bulb (having a diameter of about ⅝ inch). In such a configuration, a larger diameter LED light element 10, that provides greater illumination, can be installed in a fixture F that is designed for a smaller sized bulb.

The end caps 18 can be affixed to the support 14/lens 16 assembly in a variety of ways. In a present embodiment, each end cap 18 is affixed to the support 14/lens 16 assembly by fasteners 64, such as screws, that are positioned in recesses 66 in the end cap 18, which fasteners 64 thread into the relief areas 40. Self-threading or self-tapping screws can be used to permit readily securing the end caps 18 to the support 14/lens 16 assembly without the need for tapping holes in the support 14.

As noted above, electric conductors 20, such as wires, extend from the LED assembly 12 to the end cap pins 50 to provide power to the LED assembly 12.

Those skilled in the art will appreciate that the power requirements for an LED light element are different from those of a fluorescent light bulb. Typically, a fluorescent bulb requires a higher voltage (thus the use of a ballast) to power the bulb, compared to a much lower voltage to power an LED. Accordingly, a new or different power supply may be needed for the replacement LED light element 10. However, in that the power supply or ballast is internal to the fixture, such modifications need not be aesthetically pleasing; rather it need only be structurally and electrically acceptable, thus precluding the need to replace the entire fixture F.

The present LED light element 10 provides a number of benefits and advantages. First, it permits the use of a lower power requirement light, an LED, in an existing fluorescent fixture with minimal retrofit of the fixture. In addition, the novel end cap 18 configuration allows for the use of a large diameter light element 10 (thus more LEDs) in place of a smaller diameter fluorescent bulb. The integral heat sink, e.g., the support portion 14, assures that the LED light element 10 will operate at an acceptable temperature while providing the structural support needed for the element 10. And, in that LEDs are known to generally have a longer life than incandescent and fluorescent bulbs, it is expected that the present LED light element 10 will reduce the maintenance necessary to maintain the fixture functional and illuminating.

It will be appreciated by those skilled in the art that the relative directional terms such as sides, top, bottom, upper, lower, rearward, forward and the like are for explanatory purposes only and are not intended to limit the scope of the disclosure.

All patents referred to herein, are hereby incorporated herein by reference, whether or not specifically done so within the text of this disclosure.

In the present disclosure, the words "a" or "an" are to be taken to include both the singular and the plural. Conversely, any reference to plural items shall, where appropriate, include the singular. Further, any object modified by the word "associated" shall be construed so that it is not an element of the claim, but rather an object that is acted upon or used by the elements of the claim.

From the foregoing it will be observed that numerous modifications and variations can be made to the device without departing from the true spirit and scope of the novel concepts of the present disclosure. It is to be understood that no limitation with respect to the specific embodiments illustrated is intended or to be inferred. The disclosure is intended to cover all such modifications as fall within the scope of the claims.

What is claimed is:

1. A LED light element comprising:

a support portion;

a LED assembly mounted to the support portion, the LED assembly including a plurality of LEDs mounted thereto, the LED assembly having conductors extending therefrom;

a lens configured to engage the support portion, the lens covering the LEDs;

a pair of end caps, the end caps configured to cover ends of the support portion and lens, each end cap including a first circular portion configured to enclose its respective support portion and lens end, each end cap including a second circular portion having a diameter and a periphery that is smaller than a diameter and a periphery of the first circular portion, wherein the second portion extends in an off-center configuration from the first portion and wherein the second portion is eccentric relative to the first portion, each end cap having a pair of pins extending from the second portions, the pins being in electrical communication with the LED assembly via the conductors.

2. The light element of claim 1 wherein the lens includes a pair of flexible retaining fingers extending therefrom, the retaining fingers configured to engage the LED light assembly when the lens is in place on the support portion.

3. The light element of claim 1 wherein the second portion has a diameter of about ⅝ inches and wherein the first portion has a diameter of at least about 1 inch.

4. The light element of claim 1 wherein the support portion and the lens include securing elements to secure the lens to the mounting portion.

5. The light element of claim 4 wherein the securing elements include cooperating flanges on opposing sides of the support portion and the lens.

6. The light element of claim 1 wherein a point on a periphery of the second portion is coincidental with a point on a periphery of the first portion.

7. The light element of claim 1 wherein the pins extend from the second portion along a diameter of the second portion.

8. The light element of claim 1 wherein the support portion includes a planar mounting surface and an arcuate outer wall, and wherein the LED assembly is mounted to the planar mounting surface.

9. The light element of claim 8 wherein the arcuate outer wall has a scalloped profile.

* * * * *